US007019621B2

(12) United States Patent
Woodard et al.

(10) Patent No.: US 7,019,621 B2
(45) Date of Patent: Mar. 28, 2006

(54) METHODS AND APPARATUS TO INCREASE SOUND QUALITY OF PIEZOELECTRIC DEVICES

(75) Inventors: Stanley E. Woodard, P.O. Box 7976, Hampton, VA (US) 23666; Robert L. Fox, Hayes, VA (US); Robert G. Bryant, Lightfoot, VA (US)

(73) Assignee: Stanley E. Woodard, Hampton, VA (US)

( * ) Notice: Subject to any disclaimer, the term of this patent is extended or adjusted under 35 U.S.C. 154(b) by 646 days.

(21) Appl. No.: 09/753,370

(22) Filed: Jan. 2, 2001

(65) Prior Publication Data

US 2002/0121966 A1 Sep. 5, 2002

(51) Int. Cl.
*G08B 3/10* (2006.01)

(52) U.S. Cl. ..... 340/384.6; 340/407.1; 340/7.6; 310/311; 310/321; 310/326; 310/327; 310/332; 310/334; 310/348; 310/357; 310/367; 381/345; 381/353; 381/354; 381/190; 367/140

(58) Field of Classification Search ..... 340/384.6, 340/407.1, 407.2, 384.73, 388.1, 388.4, 404.1; 310/324, 328, 330, 340
See application file for complete search history.

(56) References Cited

U.S. PATENT DOCUMENTS 4,063,049 A * 12/1977 Pipitone et al. ..... 381/351
4,122,365 A * 10/1978 Stephens ..... 310/324
4,593,160 A * 6/1986 Nakamura ..... 381/163
4,626,730 A * 12/1986 Hubbard, Jr. ..... 310/326
4,809,552 A * 3/1989 Johnson ..... 73/514.33
5,075,548 A * 12/1991 Kajimura ..... 250/306
5,293,095 A * 3/1994 Tamura et al. ..... 310/338
5,485,053 A * 1/1996 Baz ..... 310/326
5,907,095 A * 5/1999 Lin ..... 73/105
6,078,126 A * 6/2000 Rollins et al. ..... 310/330
6,148,662 A * 11/2000 Lin ..... 73/105
6,198,206 B1 * 3/2001 Saarmaa et al. ..... 310/340
6,208,237 B1 * 3/2001 Saiki et al. ..... 340/388.1
6,211,775 B1 * 4/2001 Lee et al. ..... 340/407.1
6,359,371 B1 * 3/2002 Perkins et al. ..... 310/328
2002/0043895 A1 * 4/2002 Richards et al. ..... 310/328

* cited by examiner

*Primary Examiner*—Benjamin C. Lee

(57) ABSTRACT

A piezoelectric transducer comprises a piezoelectric component, an acoustic member attached to one of the surfaces of the piezoelectric component and a dampening material of low elastic modulus attached to one or both surfaces of the piezoelectric transducer. The piezoelectric component may comprise either an unimorph or a bimorph structure including a piezoceramic wafer made of lead zirconate titanate and a layer of dampening material sandwiched between the piezoelectric component and the acoustic member.

The acoustic member comprises a surrounding wall portion and an end portion which form an acoustic chamber when the member is mounted on a surface of the piezoelectric component. The end portion has an orifice to form a passageway from the chamber through the end portion to the outside of the member.

14 Claims, 20 Drawing Sheets

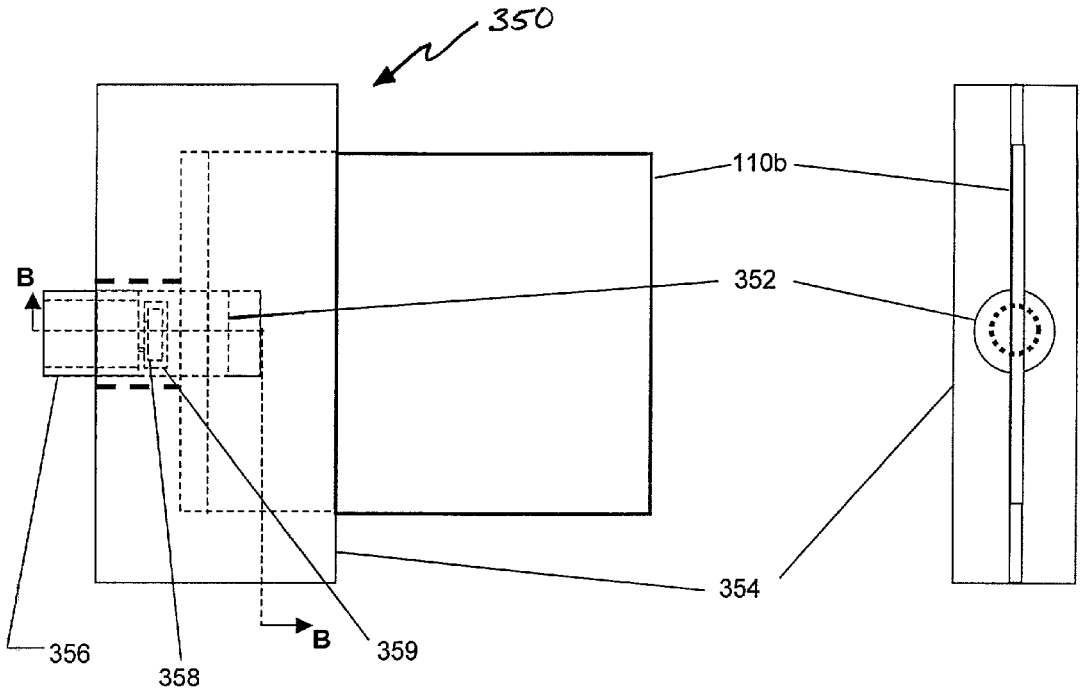
FIG. 13A
FIG. 13C
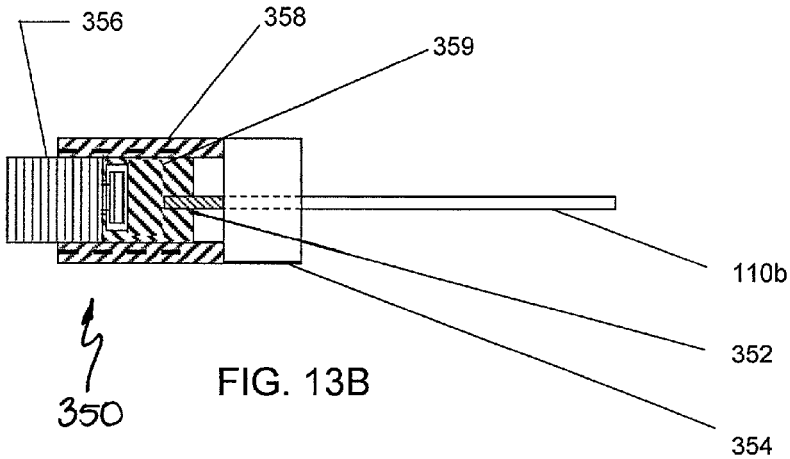
FIG. 13B

FIG. 15A Mode shape at 176 Hz

FIG. 15B Mode shape at 530 Hz

FIG. 15C Mode shape at 977 Hz

FIG. 15D Mode shape at 1730 Hz

FIG. 15E Mode shape at 1898 Hz

FIG. 15F Mode shape at 3580Hz

METHODS AND APPARATUS TO INCREASE SOUND QUALITY OF PIEZOELECTRIC DEVICES

ORIGIN OF THE INVENTION

The invention described herein was made by employees of the United States Government and may be used by or for the Government for governmental purposes without the payment of any royalties thereon or therefor.

BACKGROUND OF THE INVENTION

The present invention relates to personal communication devices, and more particularly, to a vibrational and acoustic piezoelectric transducer for use with personal communication devices.

Vibrating alarms for use with personal communication devices are well known in the art. Many of these alarms comprise conventional motors having an eccentric weight attached to the rotor shaft. Accordingly, when the motor is activated, the rotation of the rotor shaft and corresponding rotation of the eccentric weight causes vibration within the personal communication device that is detected by the holder of the device. Typically, such vibrating alarms are not capable of also producing an acoustic signal; or if the vibrating alarm is capable of producing an acoustic signal, the design does not reproduce audible sound over the full audible frequency range.

Accordingly, a need exists for a combination vibrating alarm and acoustical sound device that has a relatively uncomplicated design, is relatively inexpensive to produce, that is substantially durable and is suited (relatively lightweight and small) to be incorporated into a hand-held, personal communication device.

SUMMARY OF THE INVENTION

Accordingly, an object and advantage of the present invention is to provide a vibrating piezoelectric transducer for a personal communication device that is easily manufactured, requires a small amount of power to operate, and provides the desired amount of vibration for transmitting vibrational and acoustic signals.

According to the present invention, the foregoing and other objects and advantages are attained by providing a personal communication device comprising a housing, a receiver component, a processor and a multi-functional piezoelectric transducer. The receiver component is mounted within the housing and receives signals transmitted to the device. The processor is also mounted within the housing and is operatively coupled to the receiver component. The processor processes signals received by the receiver component and sends electrical signals to the multi-functional piezoelectric transducer. The piezoelectric transducer is also mounted within the housing and is electrically connected to the processor. The piezoelectric transducer produces mechanical vibrations in response to the electrical signals transmitted by the processor. These mechanical vibrations, which are over a broad range of frequencies, are of a force sufficient to generate a tactile alert at a predetermined first frequency, to generate an audible alert at frequencies within a second predetermined range, and to generate audible sound over the audible frequency range. These vibrations also produce a substantially flat audio response over the audible frequency range.

In an alternate embodiment, the personal communication device further comprises an audible alerting component, such as a speaker. The audible alerting component is operatively connected to the processor or to the control switch and is located within the housing. The audible alerting component vibrates at frequencies within a predetermined range so as to produce an audible, alerting sound to a user of the device. Under this embodiment, the multi-functional piezoelectric transducer still has the capability of producing an audible alert. However, the processor does not send the audible alerting signal to the multi-functional piezoelectric transducer, but rather sends it to the audible alerting component.

In an alternate embodiment, the device further comprises a power supply, operatively coupled to the processor, for supplying a voltage sufficient to cause the multi-functional piezoelectric transducer to vibrate as needed. In another alternate embodiment, the processor includes a power supply for supplying the required voltage. In yet another alternate embodiment, the device further comprises an output component, an amplifier, a control switch, and a clamp. The output component is connected to the housing and is operatively coupled to the processor. This output component visually displays signals processed by the processor, such as a phone number or other images. The amplifier is operatively coupled to the processor and amplifies electrical signals processed by the processor before they are sent to the multi-functional piezoelectric transducer. The clamp attaches to one end of the multi-functional piezoelectric transducer and mounts it within the housing, preferably in a cantilever fashion. The control switch is operatively connected to the processor or to the transducer and enables the user of the personal communication device to select the type of alert, vibrational or acoustic, which is given to a user of the device.

In accordance with another aspect of the present invention, a device for producing mechanical vibrations in response to an electrical signal comprises a piezoelectric component and at least one acoustic member attached to one of the surfaces of the piezoelectric component. The piezoelectric component has two opposing surfaces and at least two points where polarity is recognized. In an alternate embodiment, the piezoelectric component has a neck region where a clamp couples the piezoelectric component to a base. The piezoelectric component may comprise either an unimorph or a bimorph structure including a piezoceramic wafer made of lead zirconate titanate. In yet another alternate embodiment, the device for producing mechanical vibrations further comprises a dampening material, such as a polyolefin with an adhesive layer, sandwiched between the piezoelectric component and the acoustic member. In another embodiment, the dampening material may comprise a layer which attaches to substantially the entire top surface of the piezoelectric component.

In another aspect of the present invention, an acoustic member comprises a surrounding wall portion and an end portion. The surrounding wall portion has a bottom surface and a top surface. The top surface extends along a direction substantially perpendicular from the bottom surface to the top. The end portion is connected to the top surface of the surrounding wall portion. When the bottom surface of the acoustic member is attached to a surface of the piezoelectric component, the member forms an acoustic chamber. Essentially, the acoustic member is similar in structure to a bucket or open-ended barrel. The end portion has an orifice to form a passageway from the chamber through the end portion to outside the confines of the member.

Still other advantages of the present invention will become readily apparent to those skilled in the art from the following drawings and detailed description. As will be realized, the invention is capable of modifications in various obvious respects, all without departing from the invention. Accordingly, the drawings and description are to be regarded as illustrative in nature, and not as restrictive.

BRIEF DESCRIPTION OF THE DRAWINGS

FIG. 13 A is a top view of a variable mounting system in accordance with the present invention;

FIG. 13B is a cross-sectional side view along the line B—B of FIG. 13A;

FIG. 13C is an end view of a variable mounting system in accordance with the present invention;

DETAILED DESCRIPTION

A. Personal Communication Device

Figure 1:
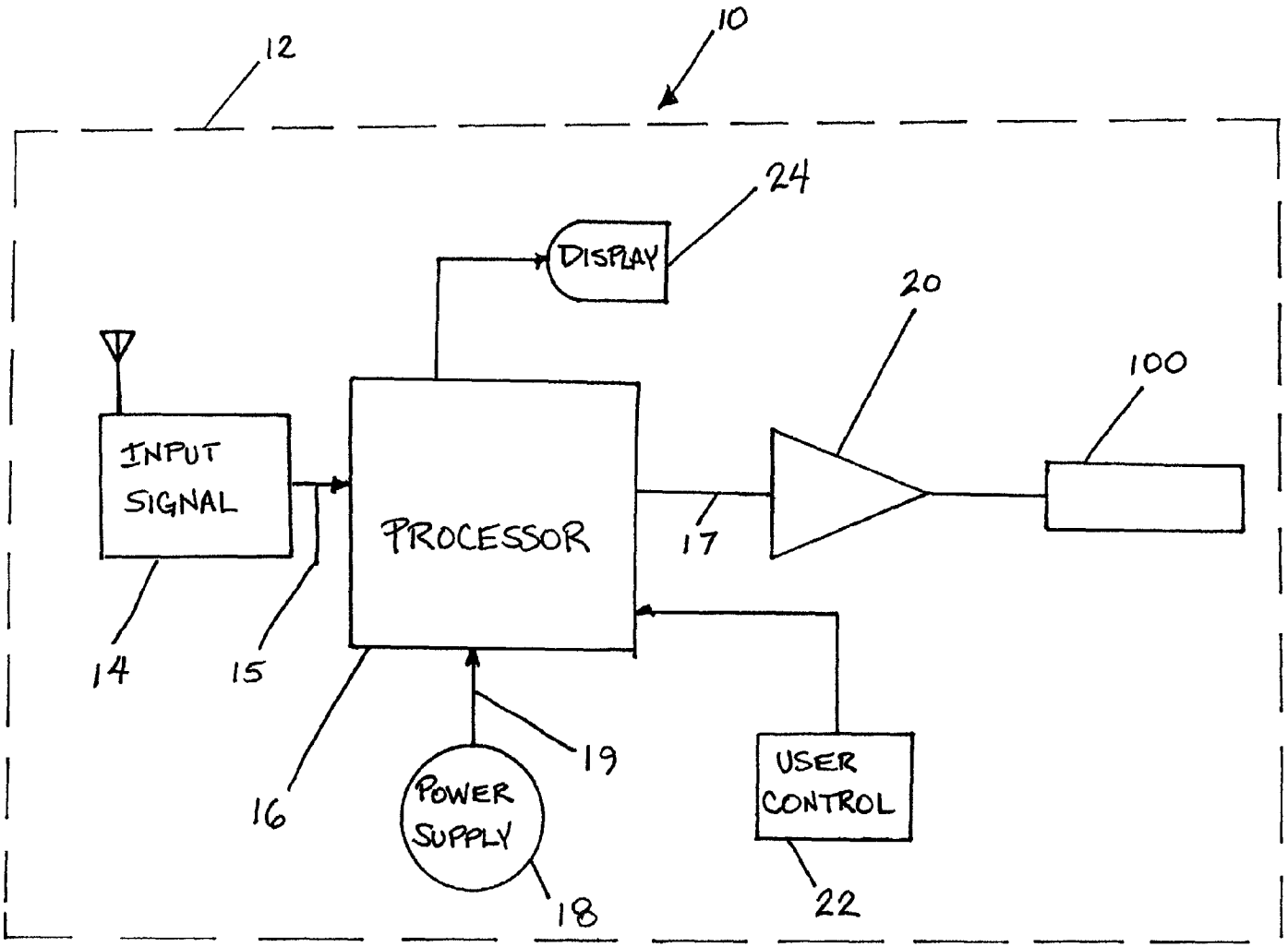
FIG. 1 is a schematic, block diagram representing a personal communication device comprising a multi-functional transducer in accordance with the present invention.

Referring now to FIG. 1, a schematic block diagram representation of a personal communication device 10 is shown incorporating a multi-functional piezoelectric transducer 100 in accordance with the present invention. The personal communication device 10 includes a housing 12, a receiver component 14 for receiving an input signal, and a processor 16 having a power supply 18. In an alternate embodiment, the device 10 further comprises an amplifier 20, a user control switch 22, and an output component or display 24.

The device 10 may be one of various types of personal communication devices, such as a cellular telephone, a walkie-talkie or other two-way radio, a pager, or any other device where tactile alert and communication of sound is desired. Examples also include the personal communication devices described in U.S. Pat. No. 5,172,092 to Nguyen et al. and in U.S. Pat. No. 5,780,958 to Strugach et al., the disclosures of both being incorporated herein by reference. The housing 12 is fabricated from a lightweight, durable material such as Acrylonitrile-Butadiene-Styrene (ABS) plastic. The receiver component 14 is mounted within the housing 12 and receives signals transmitted to the device 10. The receiver 14 may be one of various well-known receivers in the art, such as a radio frequency (RF) antenna, an infrared sensor, or a related reception device.

The processor 16 is also mounted within the housing 12, is operatively coupled to the receiver component 14, and is electrically connected to the multi-functional transducer 100. The processor 16 processes signals 15 received by the receiver component 14 and transmits a processed electrical signal 17 to the multi-functional transducer. The processor 16 also typically functions as a computer or controller to perform other processing functions.

In one embodiment, the processor 16 includes a power supply 18 for supplying a voltage 19 sufficient to cause the multi-functional piezoelectric transducer 100 to vibrate as needed. Alternatively, the power supply 18 may be a separate component, operatively connected to the processor, for supplying the required voltage. The power supply may comprise a battery, a solar cell, or any other means for providing power to the various components of the personal communication device.

Continuing to refer to FIG. 1, an alternate embodiment of the personal communication device 10 further comprises an amplifier 20 operatively coupled to the processor 16. The amplifier 20 amplifies the electrical signal 17 transmitted by the processor before it is sent to the piezoelectric transducer 100. The device 10 also comprises a user control switch 22 which is operatively coupled to the processor 16 as shown or the output of the amplifier 20 (not shown) before input to the transducer 100. The control switch 22, which may be maneuvered mechanically or electrically, enables the user of the device 10 to select the type of alert, tactile (vibrational) or audio (sound), which is to be provided to the user. The switch 22 can be controlled manually by a user or electrically by the processor 16. This alternate embodiment further comprises an output component or display 24 which is operatively coupled to the processor 16. The display 24 visually outputs electrical signals processed by the processor 16. Examples of various types of display 24 include a liquid crystal display (LCD) for displaying the incoming telephone number and other messages being received by the receiver component 14 or a light emitting diode (LED) for displaying the presence of an input signal being received by the receiver component 14. Display 24 may also include a flat-panel display for outputting video images so as to enable video-conferencing.

Figure 2:
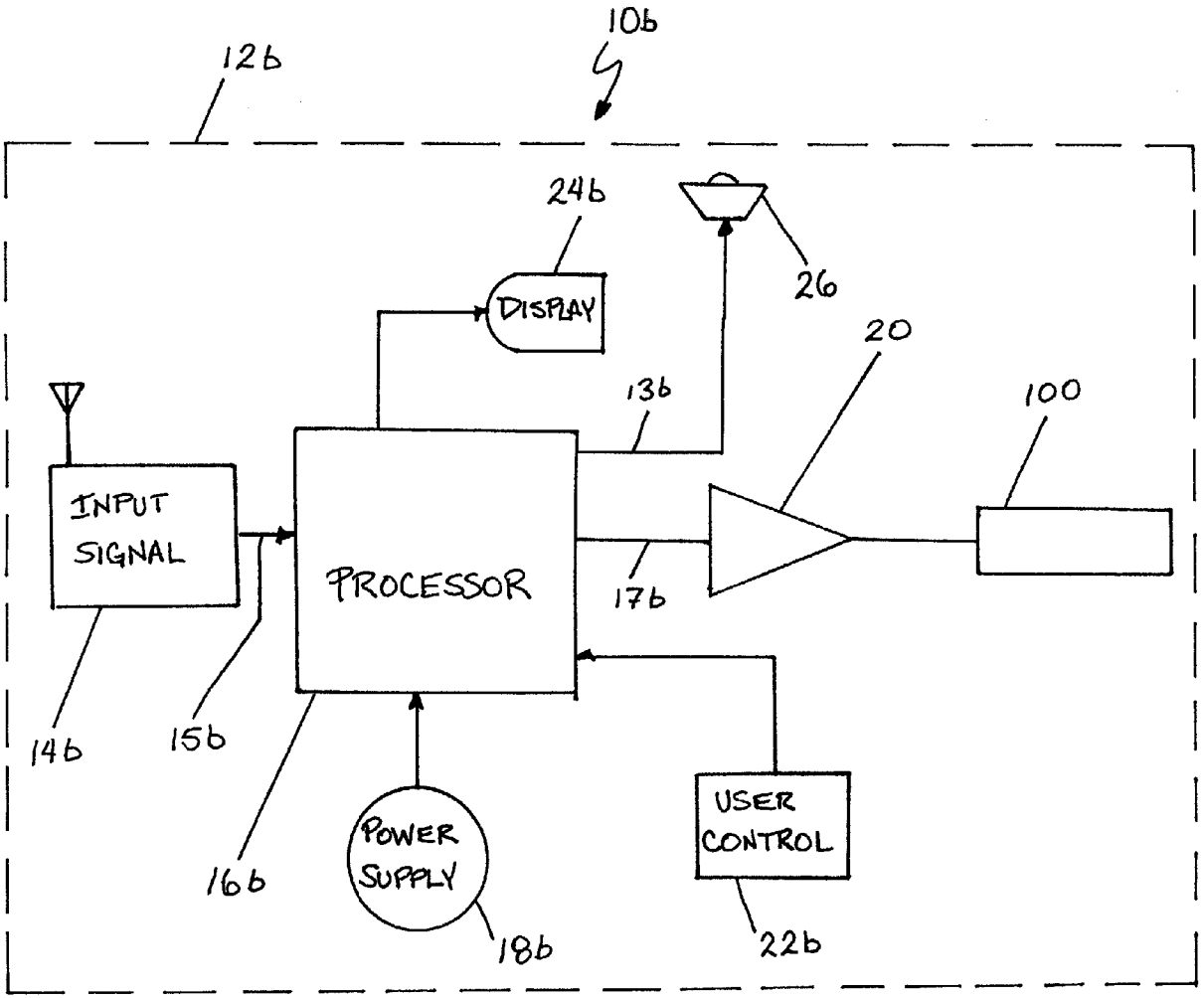
FIG. 2 is a schematic, block diagram representing an alternate device comprising a multi-functional transducer in accordance with the present invention.

Referring now to FIG. 2, an alternate embodiment of a personal communication device 10*b* is shown. In this embodiment, the device 10*b* comprises a housing 12*b*, a receiver component 14*b*, a processor 16*b*, a power supply 18*b*, an amplifier 20*b*, a control switch 22*b*, and a display 24*b*. These components 12*b*–24*b* are operatively coupled to each other in a manner substantially similar to the manner described for the similarly numbered components of device 10 in FIG. 1. The device 10*b* further comprises an audible alerting component 26 which is operatively coupled to the processor 16*b* and is located within the housing 12*b*. The audible alerting component 26 is typically a moving-coil loudspeaker and vibrates within a predetermined range of frequencies so as to produce an audible, alerting sound to a user of the device 10*b*. With this embodiment, the multi-functional transducer 100 still has the capability of providing an audible alert. However, the processor 16*b* does not send the audible alerting signal 13*b* to the transducer 100, but rather sends the signal 13*b* to the alerting component 26. This embodiment enables the audible alerting component 26 to be located within the housing 12*b* at a location separate from the component used to generate audible sound over the audible frequency range. As is understood by the skilled artisan, current FCC regulations require such a separate location for the audible alerting component.

B. Multi-Functional Piezoelectric Transducer

The piezoelectric transducer of the present invention has the capability of performing tactile alert, audio alert, and a substantially flat audio or sound pressure level response over the audible frequency range. This multi-functional transducer may be selected to perform any one or any combination of these three functions in a personal communication device as previously described in Section A. Alternatively, the multi-functional transducer may be selected to perform any one or combination of these three functions in other devices, such as conventional telephones, loudspeakers, radios, or other devices wherein a transducer for providing mechanical vibrations in response to an electrical signal is desired.

Figure 3:
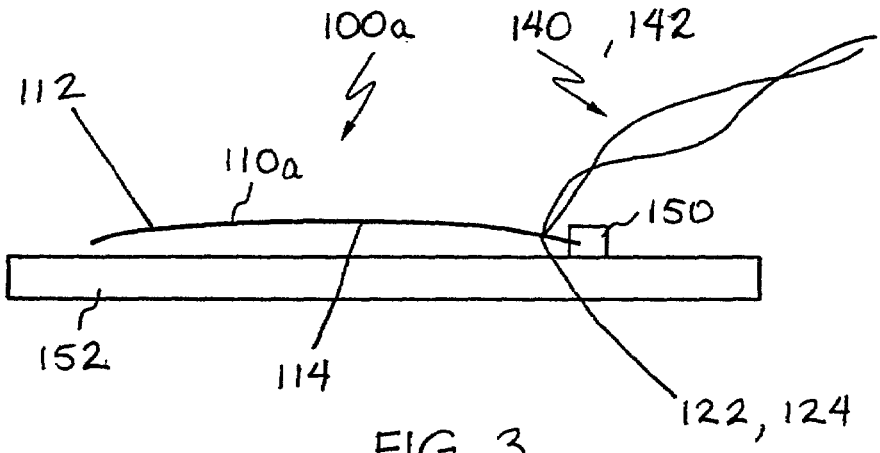
FIG. 3 is a side view of a first embodiment of the multi-functional transducer of the present invention.
Figure 4:
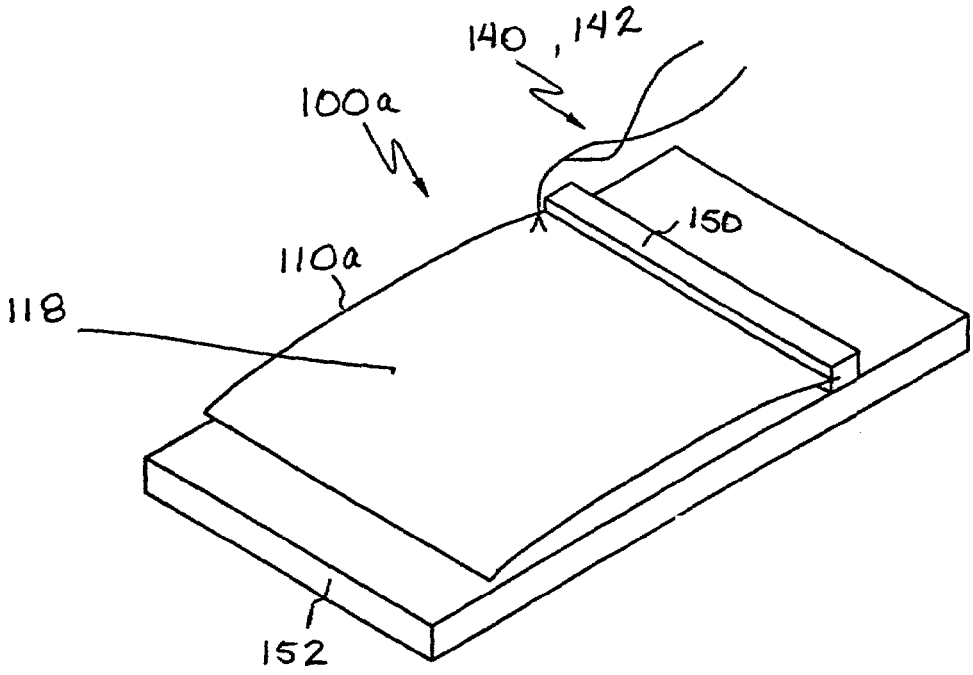
FIG. 4 is a perspective view of the transducer of FIG. 3.

Referring now to FIGS. 3 and 4, one embodiment of the multi-functional piezoelectric transducer 100 comprises the assembly 100*a*. The transducer assembly 100*a* produces mechanical vibrations in response to the electrical signals 17 transmitted by the processor 16 and typically amplified by the amplifier 20. The mechanical vibrations of the transducer assembly 100*a* are of sufficient force to generate a tactile alert at a predetermined first frequency, to generate an audible alert within a predetermined range of frequencies, and to generate sound over the audible frequency range.

As shown in FIGS. 3 and 4, the transducer assembly 100*a* comprises a piezoelectric component 110*a* having two opposing surfaces 112 and 114 and at least two points 122 and 124 where polarity is recognized. The two points 122,124 coincide with the points of attachment of two electrical leads or electrodes 140 and 142. The multi-functional transducer assembly 100*a* further comprises a clamp 150 which is positioned at one end of the piezoelectric component 110*a*. The clamp 150 is rigidly attached to a sounding board 152, which may be unitary with, or otherwise rigidly attached to, the housing 12 of the personal communication device. The clamp 150 thereby mounts the transducer piezoelectric component 110*a* within the housing. As shown in FIGS. 3 and 4, the component 110*a* is mounted in a cantilever fashion.

The component 110*a* is a planar wafer 118 which is substantially rectangularly shaped. However, as will be appreciated by those of ordinary skill in the art, the wafer may take other shapes, such as triangular, square, circular, or trapezoidal. Another example of the various shapes of the piezoelectric component includes the T-shape of component 110*c* shown in FIG. 12. The piezoelectric components 110*a* and 110*c* comprise a piezoelectric wafer having a layer of electroactive material such as lead zirconate titanate (PZT). The electroactive material responds to an electric field by developing a strain.

Figure 5:
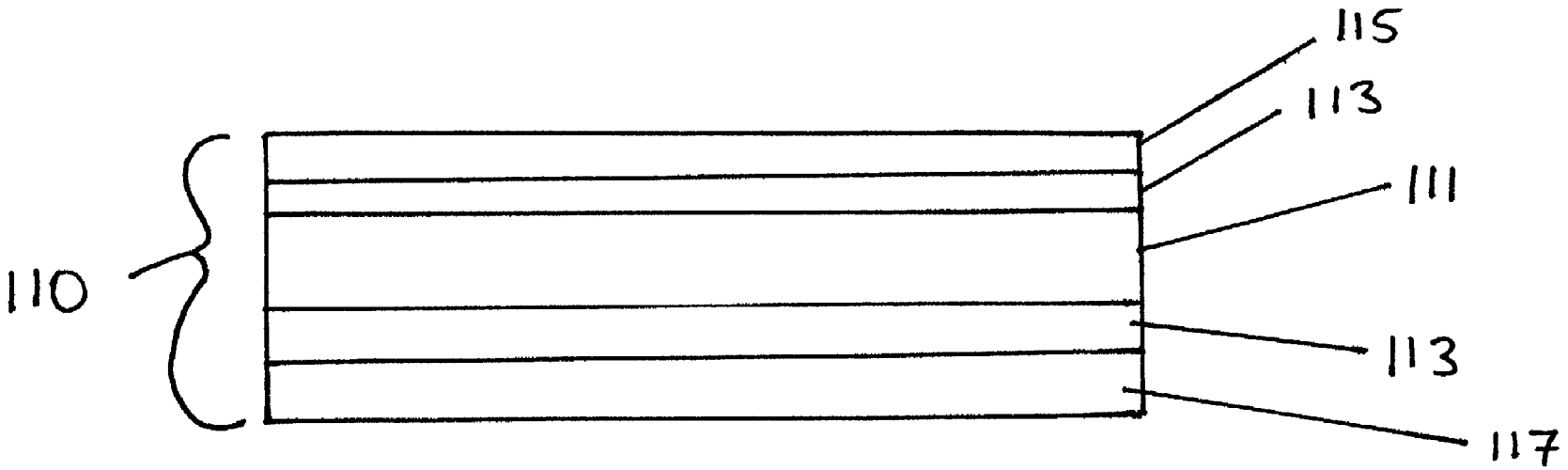
FIG. 5 is a side view of a unimorph piezoelectric structure.
Figure 6:
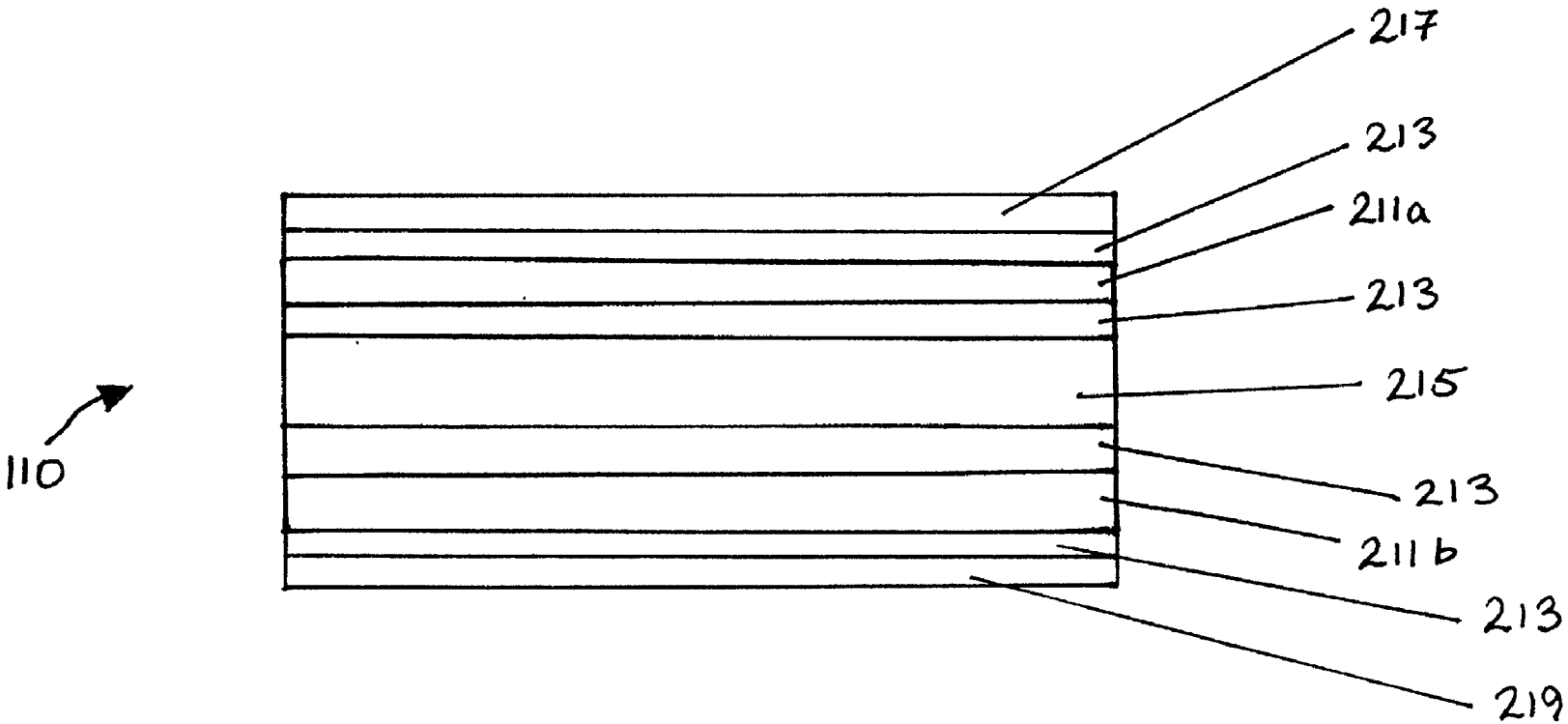
FIG. 6 is a side view of a bimorph piezoelectric structure.

The piezoelectric components 110*a* and 110*c* may comprise several different monolithic or segmented structures. An example of a monolithic, unimorph piezoelectric structure is shown in FIG. 5. An electroactive material 111 is bonded with an electrically conductive epoxy 113 to two support layers 115 and 117. An example of a monolithic, bimorph piezoelectric structure is shown in FIG. 6. In this embodiment, two layers of an electroactive material 211*a*, 211*b* are bonded with an electrically conductive epoxy 213 to an inner metallic support layer 215 and two outer support layers 217, 219. Examples of other monolithic structures for the piezoelectric components 110*a*, 110*c* include the "Thin-Layer Composite Unimorph Ferroelectric Driver and Sensor" disclosed in U.S. Pat. No. 5,632,841, which is hereby incorporated by reference, other prestressed unimorph or bimorph structures, and the "Packaged Strain Actuator" disclosed in U.S. Pat. No. 5,687,462, which is hereby incorporated by reference. An example of a segmented or fiber-like piezoelectric structure is disclosed in U.S. Pat. No. 5,869,189, which is hereby incorporated by reference.

Figure 7:
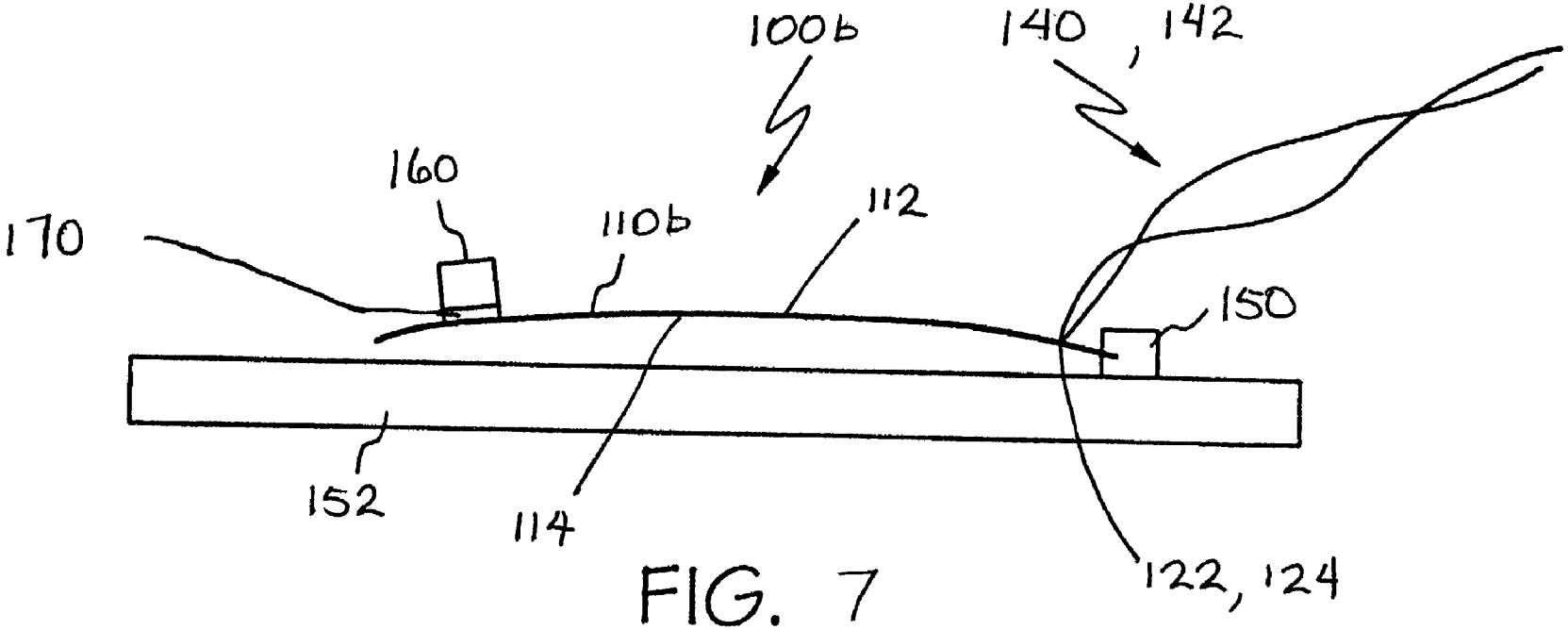
FIG. 7 is a side view of a second embodiment of the multi-functional transducer of the present invention.
Figure 8:
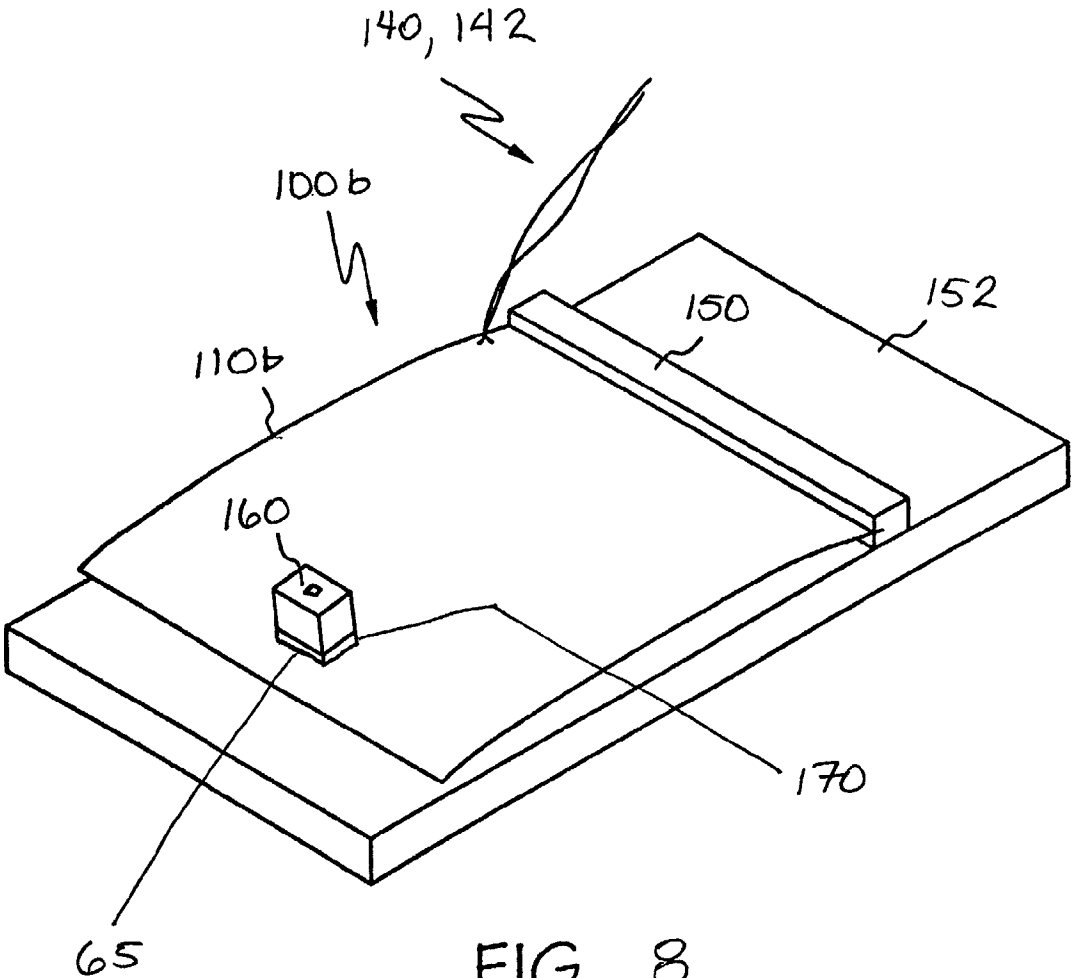
FIG. 8 is a perspective view of the transducer of FIG. 7.

Another embodiment of the multi-functional piezoelectric transducer 100 comprises the assembly 100*b* shown in FIGS. 7 and 8. The transducer assembly 100*b* also produces mechanical vibrations of sufficient force to generate a tactile alert, an audible alert, and audible sound over the audible frequency range. With this alternate embodiment, the transducer assembly 100*b* comprises the piezoelectric component 110*b*having two opposing surfaces 112, 114 and at least two points where polarity is recognized 122,124. The multi-functional transducer assembly 100*b* further comprises a clamp 150 positioned at one end of the piezoelectric component 110*b* to mount the component within the housing 12 in a cantilever fashion.

Figure 21:
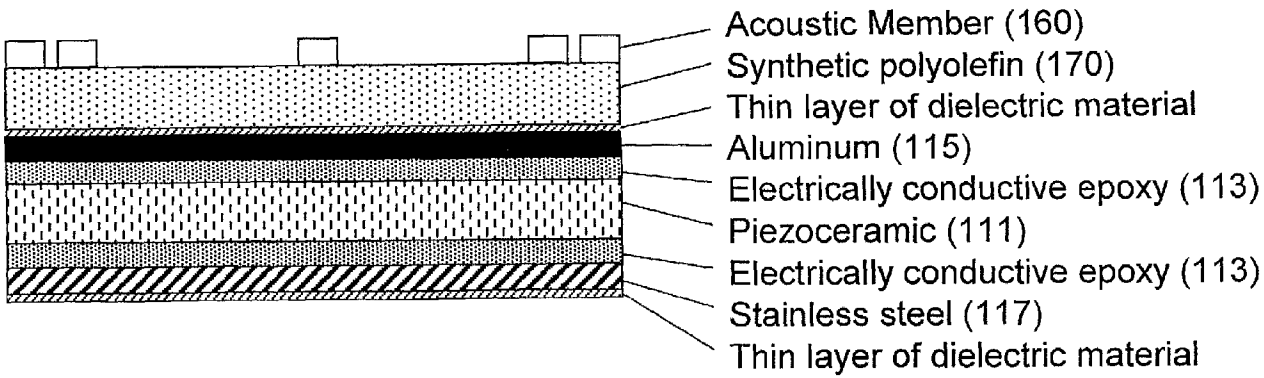
FIG. 21 is a cross-sectional side view of a unimorph piezoelectric transducer having a T-shaped planform in accordance with another one of the best modes for carrying out the invention.

The multi-functional transducer assembly 100*b* further comprises at least one acoustic member 160 attached to the surface 112. Alternatively, the transducer assembly 100*b* further comprises a dampening material 170 positioned between the piezoelectric component 110 and the at least one acoustic member 160, or the dampening material 170, as shown in FIG. 21, may extend over substantially the entire surface 112 of the piezoelectric component. Preferably, the dampening material 170 has a combination of flexure, dampening, and adhesive characteristics. An example of a material providing such characteristic is 3M Scotch™ 859 Removable Mounting Squares. This material comprises a layer of synthetic polyolefin. The material further comprises a thin adhesive layer to affix the acoustic member 160. Another example of a dampening material providing dampening and adhesive characteristics is 3M Scotch™ 468 MP Hi Performance Adhesive. Both of these materials provide beneficial acoustic and dynamic coupling properties.

In one aspect of the transducer assembly 100*b*, the acoustic member 160 is attached to the surface 112 of the piezoelectric component at an anti-node point 65, also known as a peak out-of-plane displacement point, of the piezoelectric component. Alternatively, the acoustic member 160 is affixed to the surface along the fundamental and/or non-fundamental resonant vibration anti-node lines. Both the anti-node points and the anti-node lines of the piezoelectric component are determined by understanding the natural modes of vibration of the component.

The natural modes of vibration of any structure, including the component 110*b*, is the manner of vibration associated with each particular natural frequency. The natural frequency of a structure is known as the frequency of free vibration. When a structure is subjected to an external force that is synchronized with a natural frequency, the structure enters a state known as resonance. Each state of resonance has a unique natural frequency value and a deformed configuration, known as a mode shape. The natural frequency of vibration having the lowest value is known as the fundamental mode of vibration. All other natural frequencies are known as non-fundamental modes of vibration.

When the component 110*b* is energized by an electrical signal at a particular natural frequency, the component harmonically and cyclically alternates between a deformed and an undeformed configuration as it vibrates. This alternating between deformed and undeformed configurations results in portions of the component moving perpendicular to the plane formed by a stationary, unenergized component, also known as an out-of-plane displacement. For any given resonance during vibration, one may determine either lines (anti-node lines) or points (anti-node points) that have peak out-of-plane displacements relative to other portions of the component. On the other hand, one may also determine either points or lines having minimal out-of-plane displacements relative to other portions of the component, which are known as node points or node lines. One aspect of the present invention seeks to take advantage of these vibrational attributes of the component by placing and affixing the acoustic members 160 along or at the anti-node lines or anti-node points of the piezoelectric component.

Figure 17:
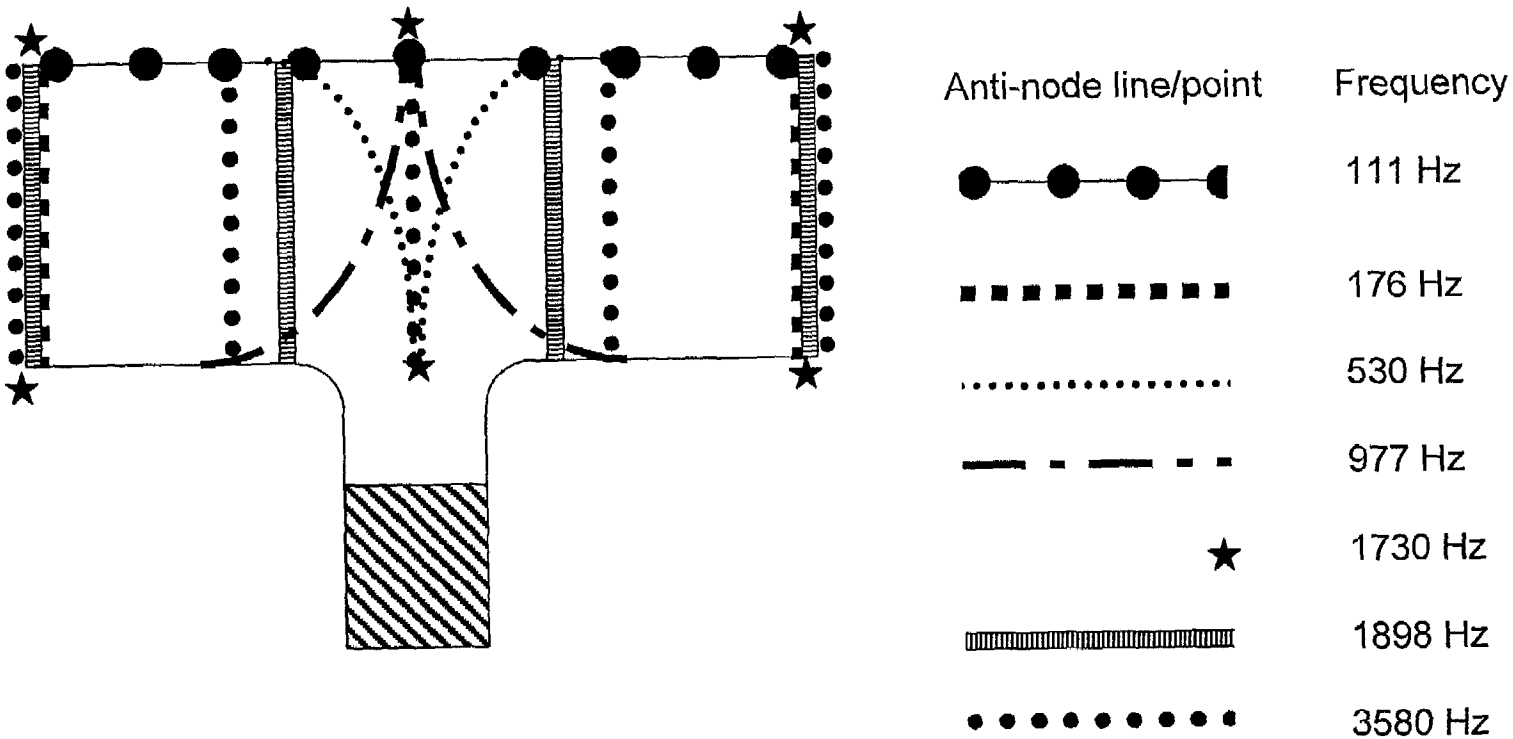
FIG. 17 illustrates a super imposition of the anti-node points or lines of the component of FIG. 15.

The method of determining the best location or locations for affixing an acoustic member requires superimposing the anti-node points and anti-node lines for the fundamental and non-fundamental modes of vibration. For example, FIG. 17 illustrates a superimposition of the anti-node points and lines of a T-shaped piezoelectric component 110*c*, which will be discussed further shortly. When two or more mode shapes share a common anti-node line or point, at least one acoustic member is placed along the common line or point. This placement takes advantage of the relatively higher out-of-plane displacement so as to produce a substantially flat sound pressure level in response to the inputted voltage across the audible frequency range.

As is understood by the skilled artisan, various techniques are available for determining the location of an anti-node point 65 or a collection of anti-node points, known as an anti-node line, of a wafer having a substantially planar geometry like the component 110*b*. Examples of these techniques include a strobe light, laser holography, shearography, and laser vibrometry. These techniques provide the mode shapes of a piezoelectric component.

Figure 9A:
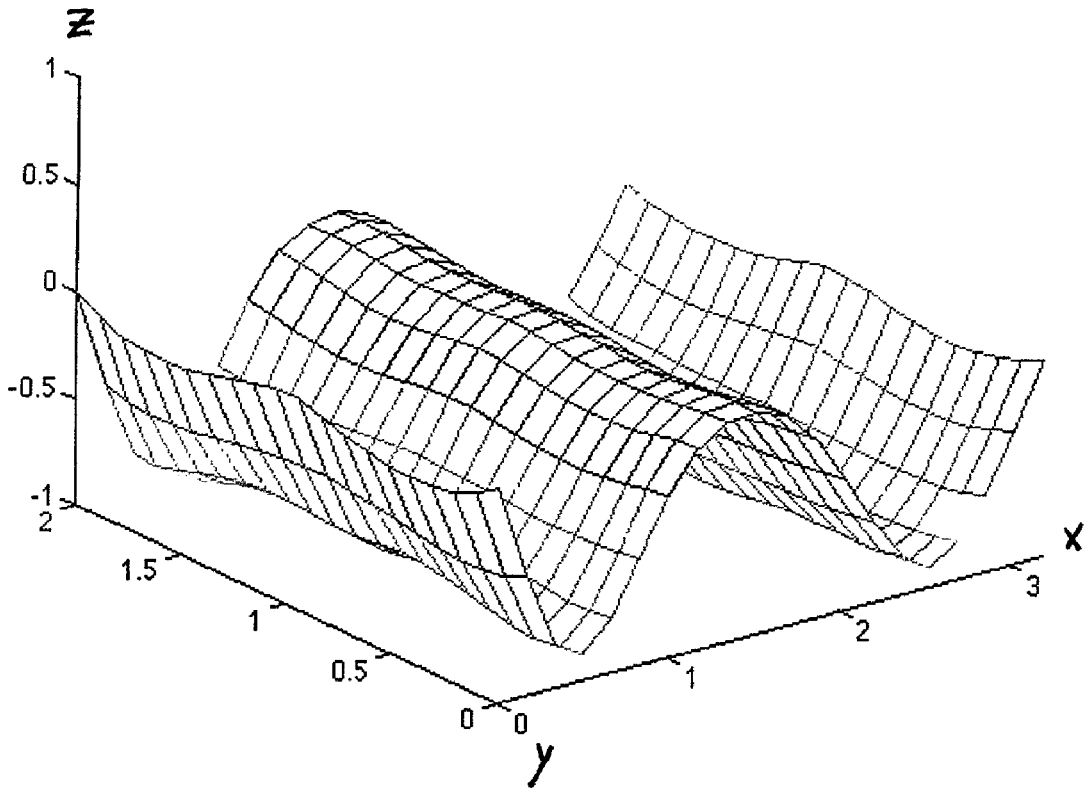
FIG. 9A shows the mode shape of a rectangular piezoelectric component mounted in a cantilever fashion vibrating at a natural frequency of 270 Hz.
Figure 9B:
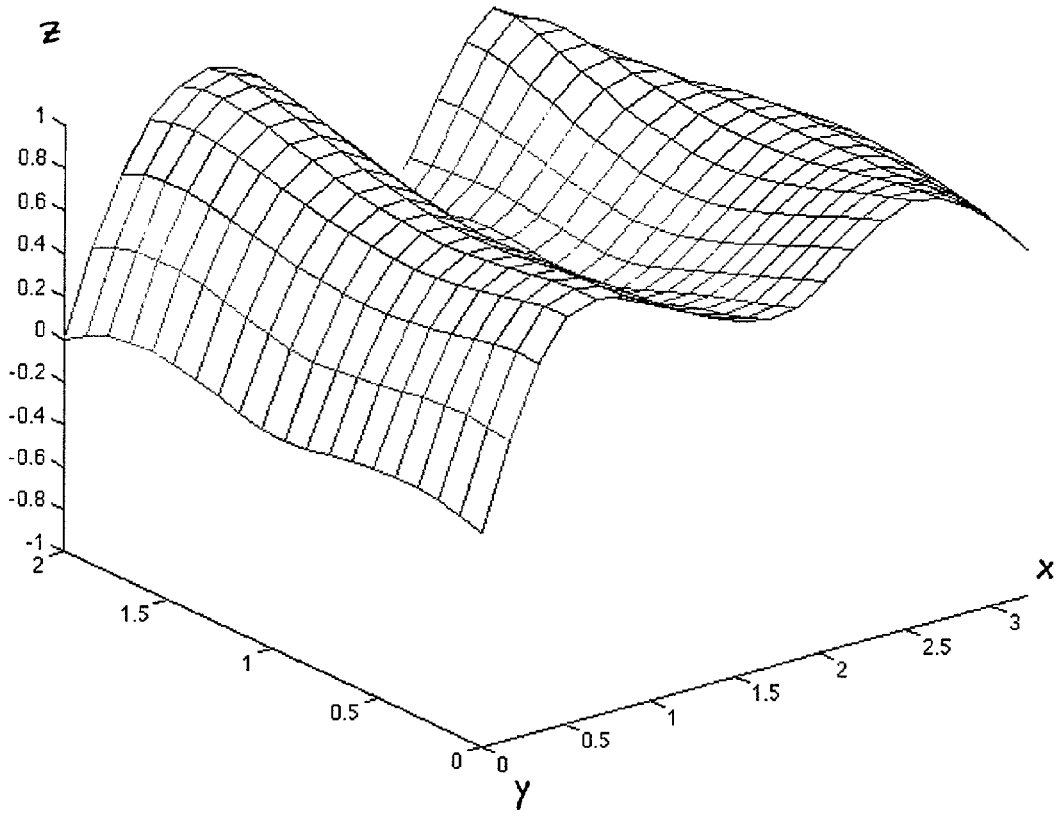
FIG. 9B shows the mode shape of a rectangular piezoelectric component mounted in a cantilever fashion vibrating at a natural frequency of 765 Hz.
Figure 10:
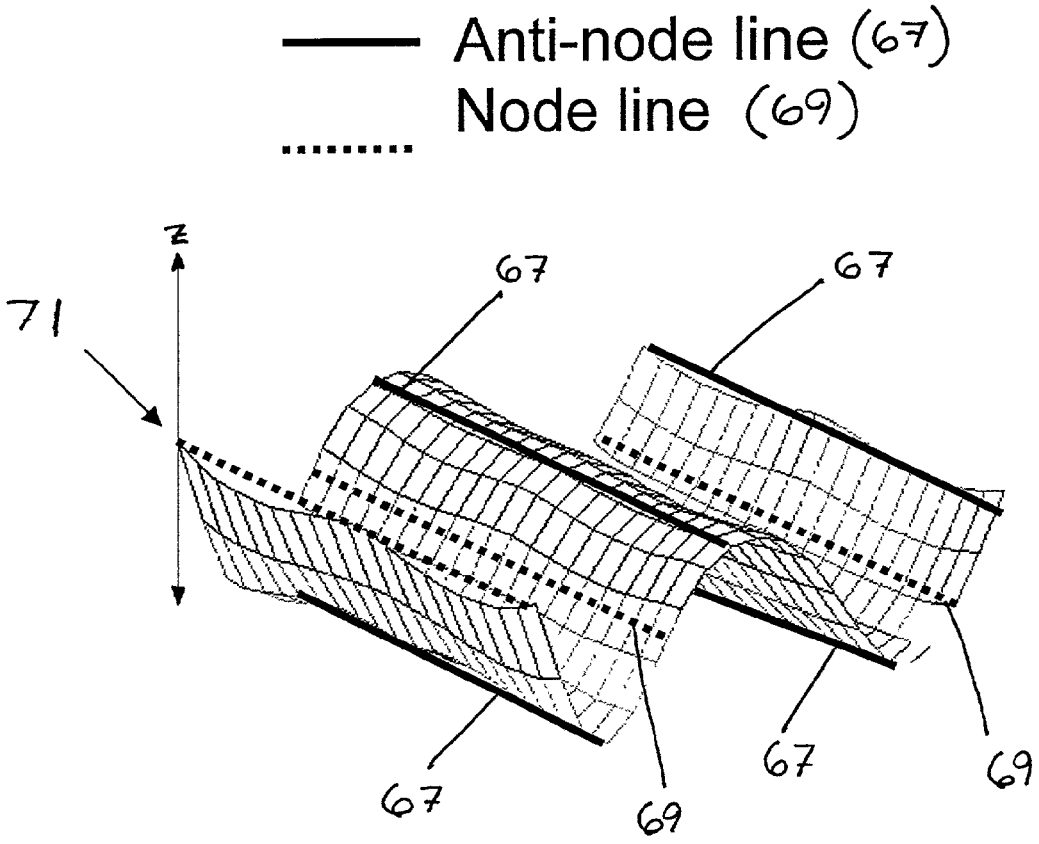
FIG. 10 illustrates the anti-node lines and node lines of the component of FIG. 9A.

Examples of the mode shapes of a rectangularly-shaped planar piezoelectric component, such as components 110*a* or 110*b*, are shown in FIGS. 9A and 9B for the two natural frequencies of 270 Hz and 765 Hz, respectively. The component was 1.75 inches wide, 3.0 inches long, and was made using the process disclosed in U.S. Pat. No. 5,632,841. During the vibrational analysis, the component was mounted in a cantilever fashion along a cantilever line which is parallel to the y-axis shown. The relative out-of-plane displacement of the component is represented along the z-axis. FIG. 10 illustrates the anti-node lines 67, or lines of peak out-of-plane displacement, and the node lines 69 of the component of FIG. 9A at the natural frequency of 270 Hz when mounted at the cantilever line 71. Accordingly, the examination of the modes of vibration of a particular piezoelectric component enables one to determine the anti-node points or lines and position an acoustic member accordingly.

Figure 11:
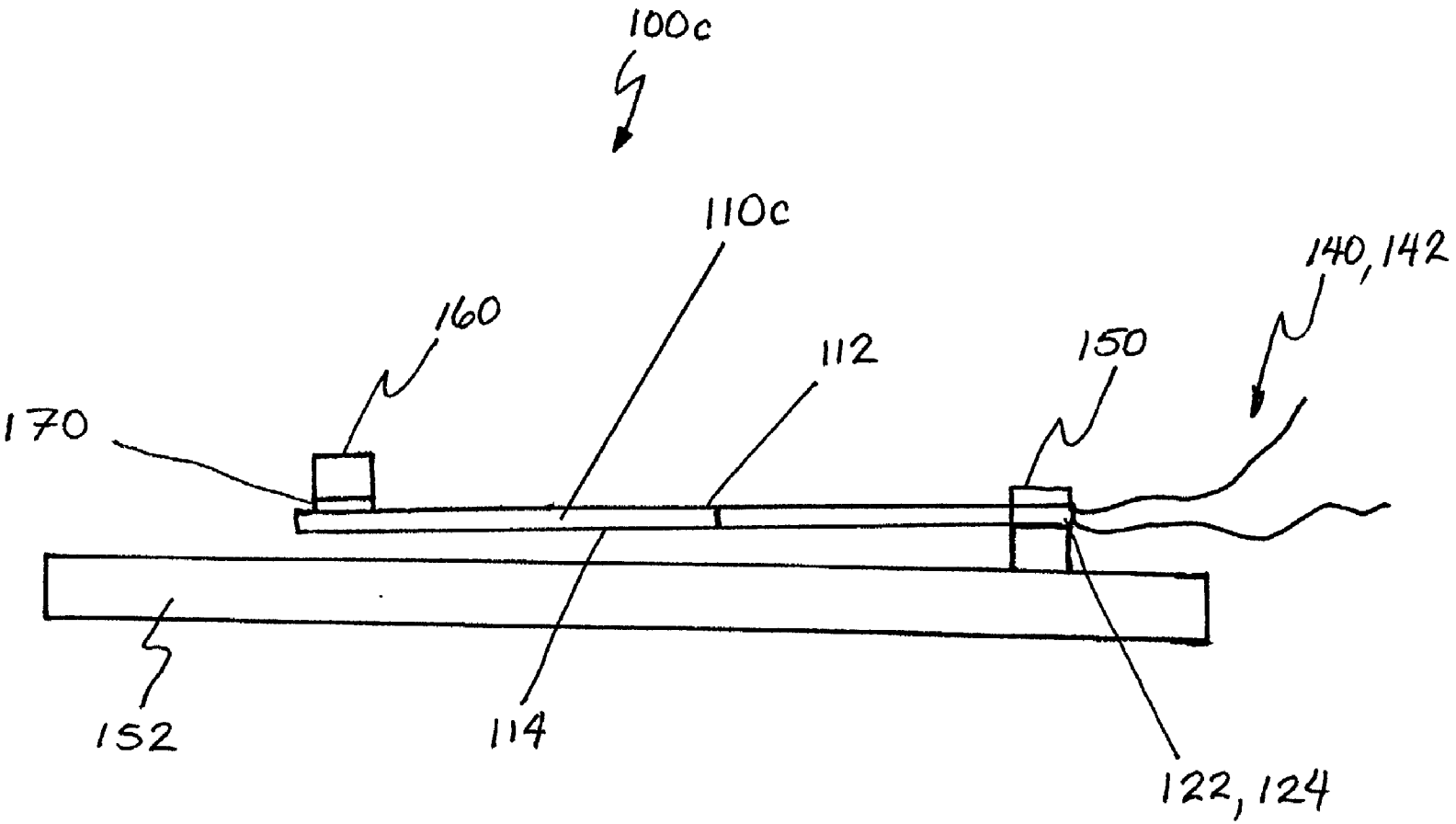
FIG. 11 is a side view of a third embodiment of the multi-functional piezoelectric transducer of the present invention.
Figure 12:
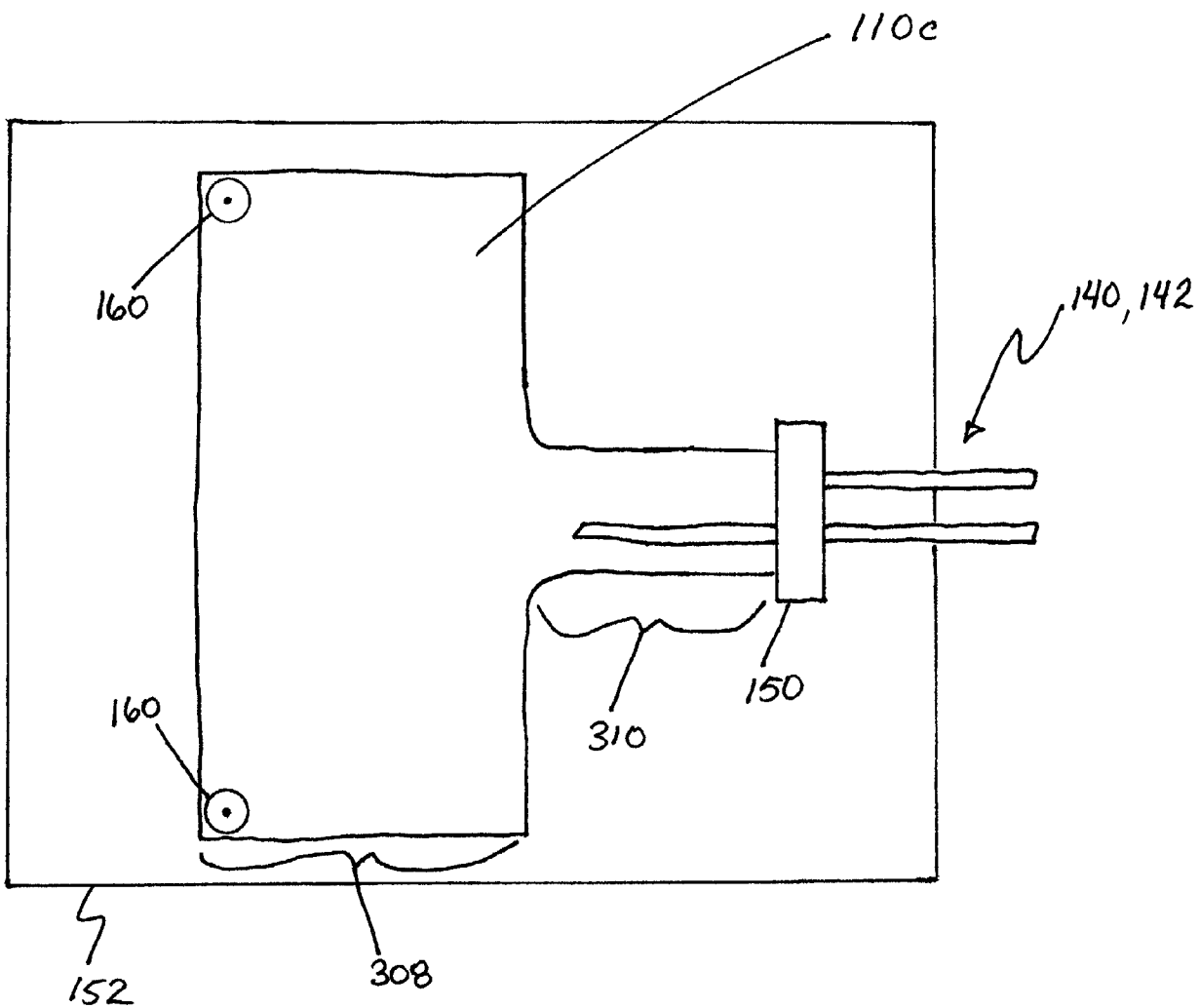
FIG. 12 is a top view of a third embodiment of the multi-functional piezoelectric transducer of the present invention.

Referring now to FIGS. 11 and 12, a third embodiment of the multi-functional piezoelectric transducer 100 is shown comprising assembly 100*c*. Assembly 100*c* produces mechanical vibrations of sufficient force to generate a tactile alert, an audible alert, and audible sound over the audible frequency range. Under this embodiment, the transducer assembly comprising the piezoelectric component 110*c* again has two opposing surfaces 112, 114 and at least two points where polarity is recognized 122, 124. As shown in the top view of FIG. 12, the piezoelectric component 110*c* has a T-shaped geometry or planform which comprises a crossbar region 308 and a neck region 310 extending from one side of the piezoelectric component. The neck region 310 is operatively connected to a clamp 150, which couples the component 110*c* to the sounding board 152. Again, the sounding board 152 may be unitary with, or otherwise rigidly attached to, the housing 12 of the personal communication device. The clamp 150 couples the component 110*c* to the sounding board 152 in a cantilever fashion.

Although a clamp is illustrated in FIGS. 11 and 12, it is to be understood, as will be appreciated by those of ordinary skill in the art, that other means for connecting the piezoelectric component (110*a*, 110*b* or 110*c*) to the sounding board 152 in a cantilever fashion may also be used. Such means for connecting would include a bracket with a retaining screw, two or more clamps, or a mounting system which can vary the mounting position and vibrational area of the component by adjusting the mounting location of the component.

An example of a variable mounting system 350 is shown in FIGS. 13A–C for a rectangularly-shaped component 110*b*. The variable mounting system 350 comprises a variable position clamp 352 and a mounting sleeve 354. The threaded clamp 352 comprises an adjustment screw 356 including an adjustment screw key 358 which fits within an adjustment screw key slot 359. The adjustment screw 356 may be turned to adjust the exposed length of the component 110*b* as it extends away from the mounting sleeve 354. Variations in the vibrational area of the component 110*b* has an impact on the modal dynamics of the component. The variable mounting system 350 is used primarily to alter the bending modes of vibration of the component.

Figure 14A:
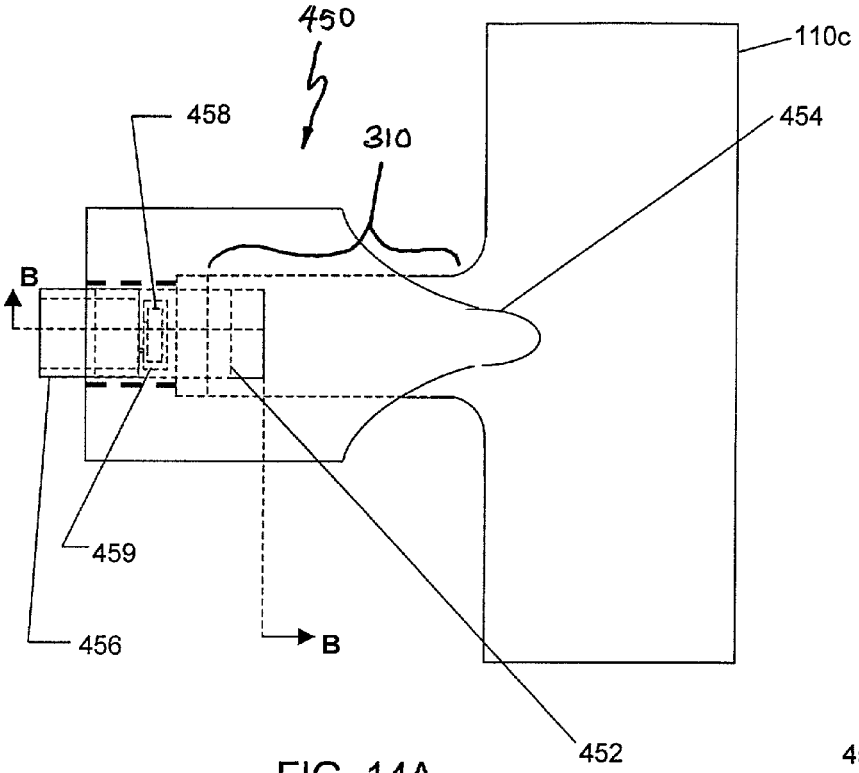
FIG. 14A is a top view of an alternate embodiment of the variable mounting device of the present invention.
Figure 14C:
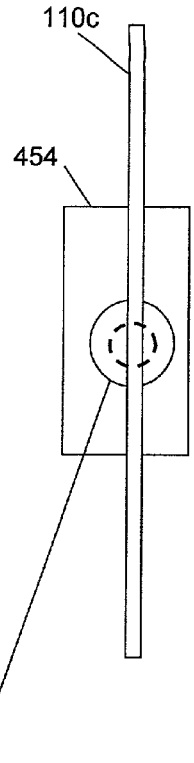
FIG. 14C is an end view of an alternate embodiment of the variable mounting device of the present invention.
Figure 14B:
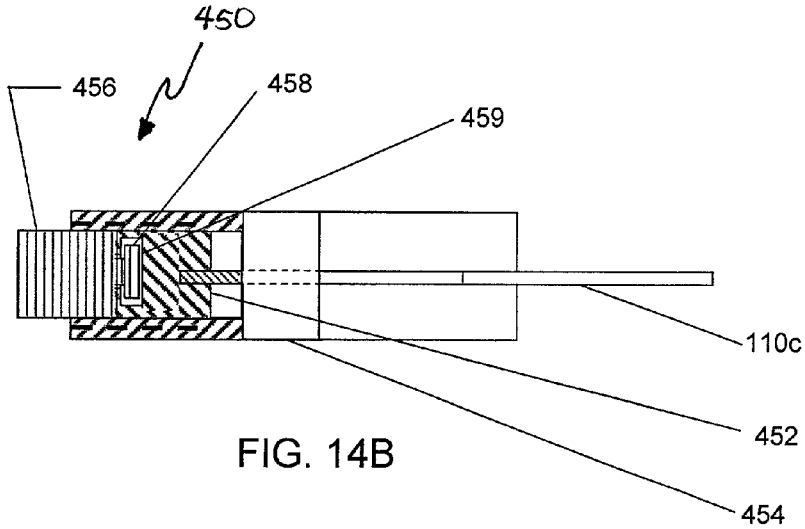
FIG. 14B is a cross-sectional side view along the line B—B of FIG. 14A.

An example of a variable mounting assembly 450 for a T-shaped component 110*c* is shown in FIGS. 14A–C for varying the mounting location of the component 110*c* along the neck region 310. The variable mounting assembly 450 comprises a variable position clamp 452 and a mounting sleeve 454. The threaded clamp 452 comprises an adjustment screw 456 including an adjustment screw key 458 which fits within an adjustment screw key slot 459. The adjustment screw 456 may be turned to adjust the exposed length of the component 110*c* as it extends away from the mounting sleeve 454. Variations in the vibrational area of the component 110*c* has an impact on the modal dynamics of the component. The variable mounting assembly 450 is used to alter the torsion and bending modes of vibration of the component 110*c*.

As can be seen in FIGS. 11 and 12, the component 110*c* further comprises at least one acoustic member 160 attached to the surface 112 by an adhesive, flexible dampening material 170. Again, an example of such a dampening material includes 3M Scotch™ 859 Removable Mounting Squares. The acoustic members 160 may be located at an anti-node point or line of the component 110*c*.

As discussed earlier, anti-node points or lines are determined by measuring the vibrational characteristics of the piezoelectric component. Examples of the mode shapes for the T-shaped planar piezoelectric component 110*c* are shown in FIGS. 15A–15F for six different natural frequencies of 176 Hz, 530 Hz, 977 Hz, 1730 Hz, 1898 Hz, and 3580 Hz, respectively. During the vibrational analysis, the component was mounted in a cantilever fashion along a cantilever line which is parallel to the y-axis shown. The zero value of the x-axis indicates the point where the neck region 310 of the component ends and the crossbar region 308 of the component 110*c* begins. The relative out-of-plane displacement of the component is represented along the z-axis.

Figure 15:
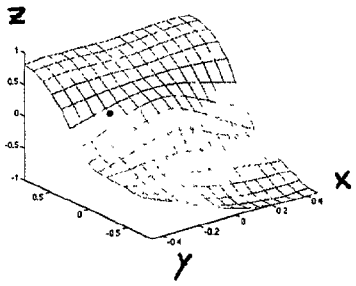
FIGS. 15A–F illustrate mode shapes of a T-shaped piezoelectric component at six different natural frequencies.
Figure 15:
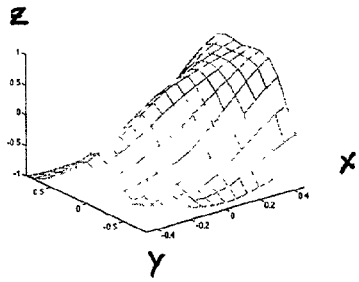
Figure 15:
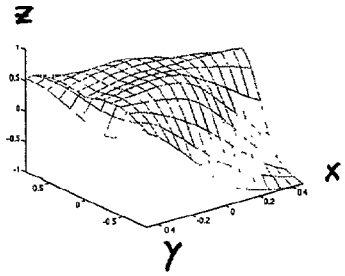
Figure 15:
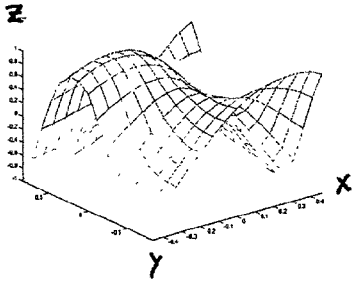
Figure 15:
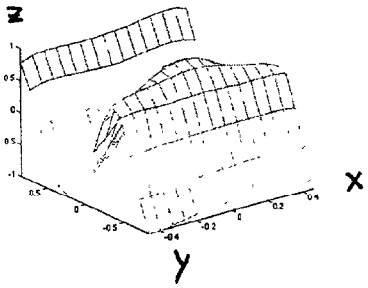
Figure 15:
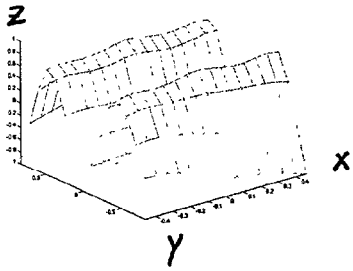
Figure 16:
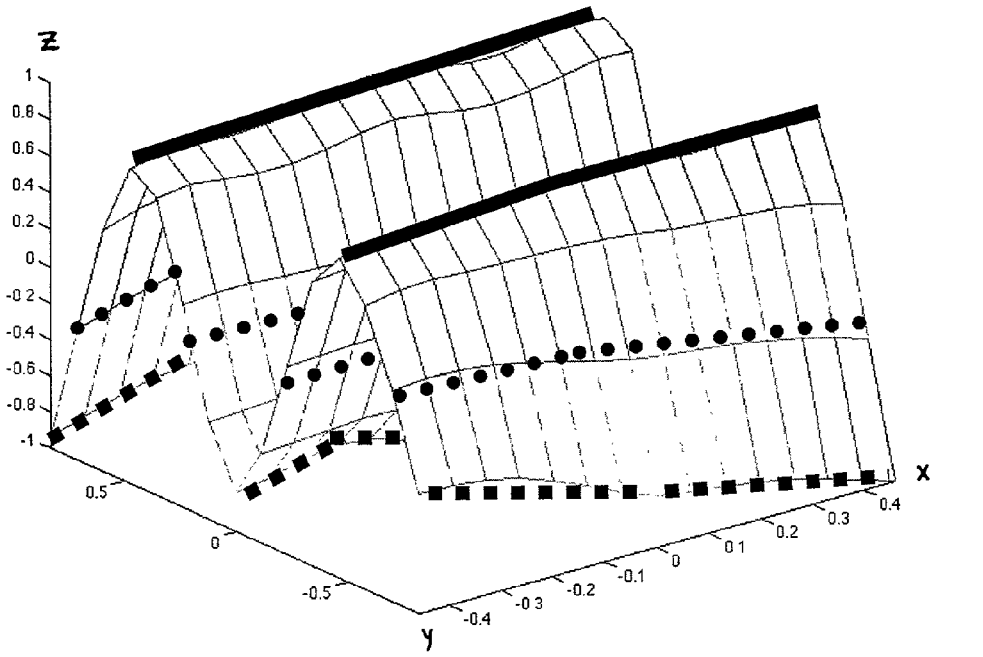
FIG. 16 illustrates the anti-node lines and node lines of the component of FIG. 15F.

FIG. 16 illustrates the anti-node lines 67 and node lines 69 for the component 110*c* of FIG. 15F at a frequency of 3580 Hz. As discussed earlier, the method of determining the best location or locations for affixing an acoustic member requires superimposing the ani-node points and anti-node lines for the fundamental and non-fundamental modes of vibration. FIG. 17 illustrates a superimposition of the anti-node points and lines of the T-shaped piezoelectric component 110*c* for the fundamental frequency (or first natural frequency) of 111 Hz and six non-fundamental frequencies of 176 Hz, 530 Hz, 977 Hz, 1730 Hz, 1898 Hz, and 3580 Hz. When two or more mode shapes share a common anti-node line or point, at least one acoustic member is placed along the common line or point to take advantage of the broader frequency range of relatively higher out-of-plane displacement. One objective is to produce a substantially flat audio output (i.e., sound pressure level) in response to the inputted voltage across the audible frequency range. The sound pressure level measured using the T-shaped component of FIG. 17 was 95 dB (+/−5 dB) for frequencies between 600 Hz and 5000 Hz. The sound pressure level measured for this component also increased at a relatively monotonic rate from 60 dB to 90 dB for the frequency range of 0 Hz–600 Hz.

C. Acoustic Member

The acoustic member of the present invention has the capability of producing sound after it is operatively connected to the surface of any piezoelectric component as described in Section B. Alternatively, the acoustic member may be operatively connected to the surface of any transducer capable of producing mechanical vibrations in response to an electrical signal when a substantially flat acoustic response is desired.

Figure 18A:
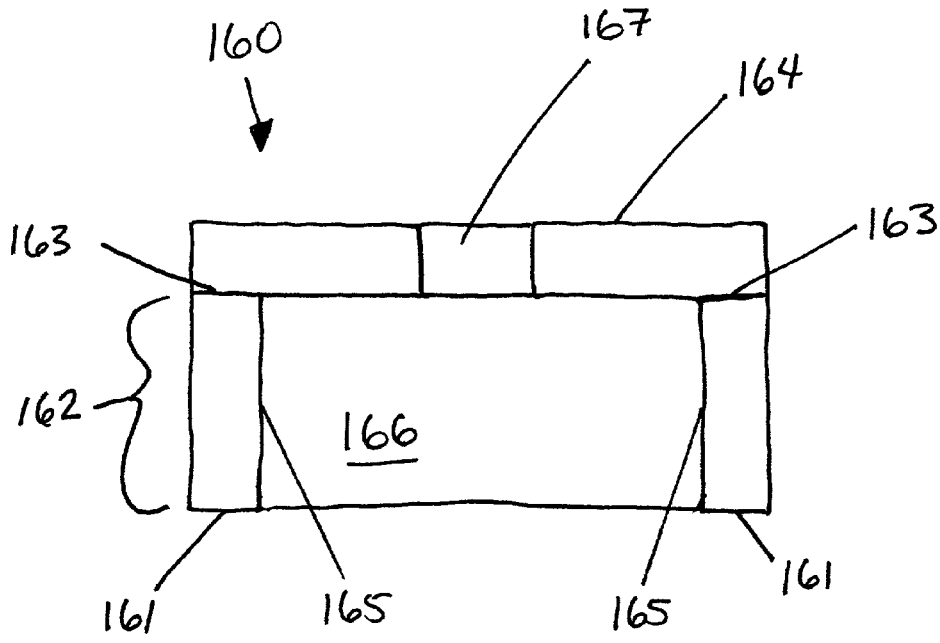
FIG. 18A is a cross-sectional side view of an acoustic member in accordance with the present invention.

Referring now to FIG. 18A, a cross-sectional view of an acoustic member 160 is shown detailing its basic structure. Essentially, the acoustic member is similar in structure to a bucket or open-ended barrel. The member 160 comprises a surrounding wall portion 162 and an end portion 164. The surrounding wall portion 162 has a bottom surface 161 and a top surface 163. The surrounding wall portion 162 extends in a direction substantially perpendicular from the bottom surface 161 to the top surface 163, thereby creating a surrounding wall 165. The end portion 164 is operatively connected to the surrounding wall portion 162 at the top surface 163 in such a manner as to form a chamber 166 when the member 160 is affixed to the surface of a piezoelectric component.

Figure 18B:
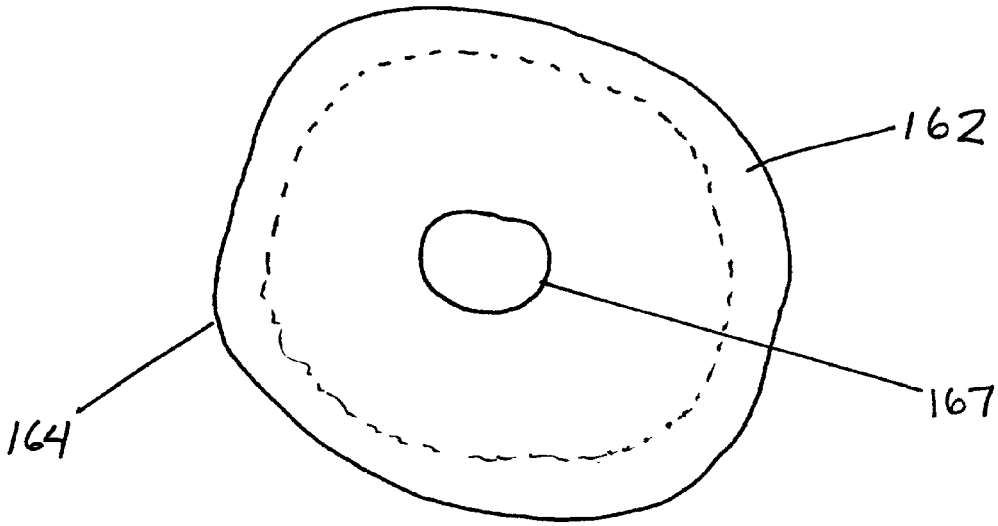
FIG. 18B is a top view of the acoustic member of the present invention.

The end portion 164 further comprises an orifice 167 which forms a passageway through the end portion to the chamber 166. As shown in FIG. 18B, one embodiment of the member 160 has the surrounding wall portion 162 being substantially cylindrical in shape and the end portion 164 being substantially circular. As shown in FIG. 8, the acoustic member 160 may also comprise a box-shaped wall portion and a rectangularly-shaped end portion.

Although the structure of the acoustic member is described as having two portions, it is to be understood that the acoustic member 160 may comprise one unitary structure or article of manufacture. Accordingly, the surrounding wall portion 162 and the end portion 164 may be made and formed from the same material. Plastic is one material which has provided good results, although metallic materials having good structural properties may also be used.

Additionally, it is to be understood that, while the acoustic member has been described as having essentially the shape of a bucket, other shapes or structure which can form a chamber would provide similar results. The acoustic member, by being affixed to the surface of the piezoelectric component, in effect functions in a manner similar to a Helmholtz resonator. Accordingly, other shapes or structure which have the basic structural characteristics of a Helmholtz resonator would provide similar results. Such basic structural characteristics include a chamber or cavity having a predetermined volume and a passageway or neck having a predetermined cross-sectional area and a predetermined neck length. Examples of such shapes or structures include the box-shaped structure of FIG. 8 having six surrounding walls, with one of the surrounding walls having an orifice. Another example would include a hollow spherical structure having an opening at a necked region, known in the art as being a "classical Helmholtz resonator."

Figure 19:
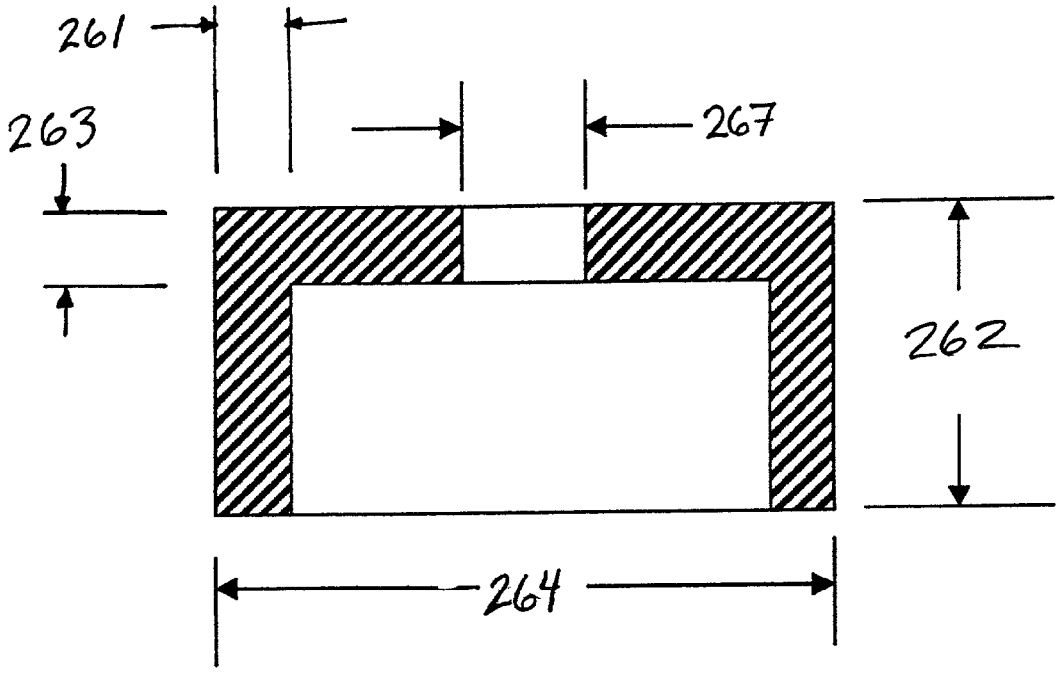
FIG. 19 is another cross-sectional view of the acoustic member of the present invention.

The acoustic chamber 160 generally has several dimensions which may be varied. Referring to FIG. 19, these dimensions include the orifice width 267, the total height of the member 262 (which includes the end portion), and the diameter or girth of the end portion 264. The table below provides examples of the various dimensions which have provided good results. Additionally, the surrounding wall portion 162 and the end portion 164 each have a particular thickness, 261 and 263, respectively. The thickness of the surrounding wall portion 261 may be greater or less than the thickness of the end portion 263, or the thicknesses may be same. In the examples listed in the table below, the wall thicknesses 261 and 263 were all 0.03 in. Generally, the dimensions of the acoustic member (wall thicknesses 261 and 263, member height 262, end portion diameter 264, and orifice size 267) should be selected to produce a resonating frequency that interacts with one of the resonating frequencies of the piezoelectric component. Again, one object of the invention is to produce a substantially flat audio output (i.e., sound pressure level) in response to the inputted voltage across the audible frequency range.

| | Dimensions | | |
|---|---|---|---|
| Example | 262 (in.) | 264 (in.) | 267 (in.) |
| A | 0.1 | 0.2 | 0.01 |
| B | 0.1 | 0.3 | 0.01 |
| C | 0.1 | 0.3 | 0.075 |

The sound waves emanating from the acoustic member are produced by a collection of the out-of-plane displacements of the component. The displacement of each acoustic member causes air to pass through its orifice. The sound range of an acoustic member is dependent upon its physical dimensions and its location on the piezoelectric component. Some of the dimensions of an acoustic member which affect the sound produced include the orifice size (both diameter and depth), the volume of the chamber, and the material being used. The location of the acoustic member on the piezoelectric component determines which mode shapes will influence the acoustic member's displacement (both in amplitude and in frequency).

The sound of each acoustic member is independent of any other acoustic member affixed to the piezoelectric component. When more than one member is used, the sound coalesces to create a rich, full blend. Hence, using more than one acoustic member should result in a greater sound pressure level and a fuller audible range for the multi-functional transducer being used.

D. Operation of the Invention

The transducer assemblies (100*a*, 100*b*, or 100*c*) are all adapted to provide vibrational (tactile) alert, acoustic (sound) alert, and full-range audible sound over the audible frequency range. Accordingly, the processor 16 is designed to output vibrational and acoustic signals 17. When the processor transmits an electrical signal for tactile alert, it transmits an alternating voltage signal at a predetermined first frequency of approximately 300 Hz or less. It is to be understood that an "alternating voltage" signal may be a standard AC signal or a switched DC signal (such as a square wave or the like). When the processor determines to transmit an electrical signal for audio alert, it transmits an alternating voltage signal at a second predetermined range of frequencies between approximately 300 Hz and 12,000 Hz. This particular signal is transmitted either to the transducer assembly (100*a*, 100*b*, or 100*c*) or, if being used, the audible alerting component 26. When the processor 16 determines to transmit electrical signals corresponding to sounds over the broad range of audible frequencies, it transmits these signals to the transducer assembly for sound production. The voltage level needed to vibrate the transducer depends on the thickness of the piezoceramic wafer and preferably ranges from 20 to 120 volts. Typically, the power supply 18 has an output from 1.5 to 10 volts. Higher or lower voltages may also be used.

EXAMPLES OF THE BEST MODE FOR CARRYING OUT THE INVENTION

Figure 20:
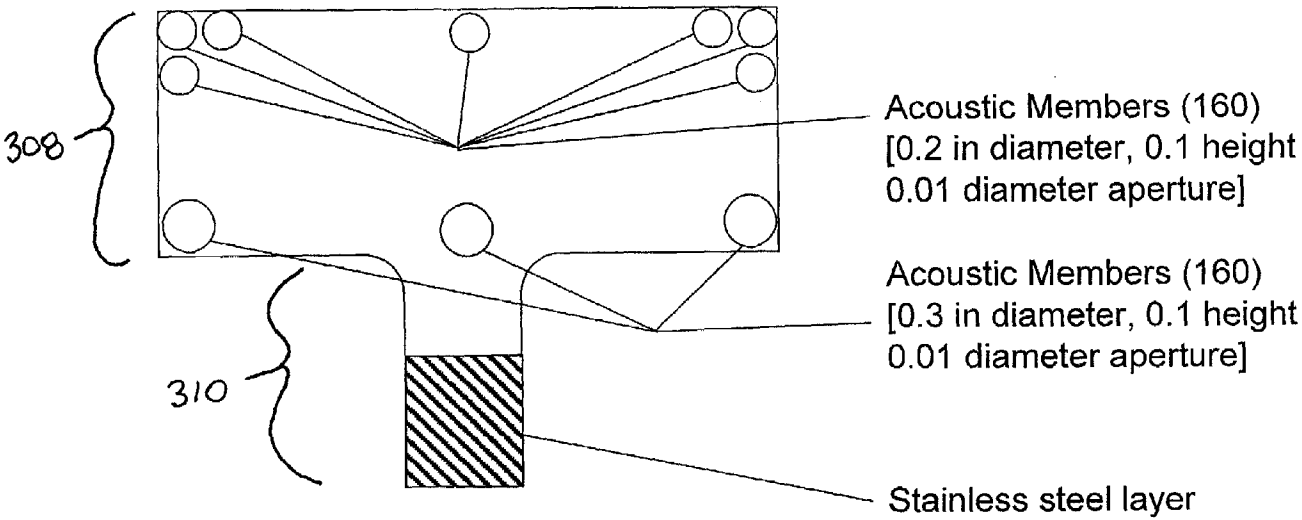
FIG. 20 is top view of a bimorph piezoelectric transducer having a T-shaped planform in accordance with one of the best modes for carrying out the invention.

FIG. 20 illustrates a first example for carrying out a multi-functional transducer to generate a tactile alert, an audible alert, and sound over the audible frequency range. The transducer comprises a bimorph piezoelectric component having a T-shaped planform. The cross bar region 308 had a width of 1.75 inches and a length of 1.0 inches extending from the neck region 310. The neck region was 0.5 inch wide and 0.5 inch long. The neck region was reinforced with a 1 mil layer of stainless steel extending 0.25 inch beyond the neck region.

The transducer assembly of the first example was laminated as follows from its top surface to its bottom surface:

Acoustic Members

Adhesive synthetic polyolefin (3M Scotch™ 859 Mounting Squares)

1 mil of adhesive Kapton® film (as a dielectric material for electrical insulation)

1 mil of aluminum (supporting layer)

1 mil of electrically conductive epoxy 4 mil of a piezoceramic (PZT)

1 mil of electrically conductive epoxy 1 mil of stainless steel (supporting layer)

1 mil of conductive epoxy 4 mil of PZT 1 mil of conductive epoxy 1 mil of aluminum (supporting layer)

1 mil of adhesive Kapton® film (as a dielectric)

As illustrated in FIG. 20, the acoustic members are made of the two sizes A and B previously listed in the table of examples. Seven members of size A and three members of size B were positioned at the locations indicated in FIG. 20.

When the piezoelectric transducer is used primarily to generate sound over the audible frequency range, then an alternative best mode is a unimorph structure as shown in FIG. 21. With this second example, the piezoelectric component has the same T-shaped planform as described for the first example and illustrated in FIG. 20. The layered unimorph structure is laminated, however, as indicated in FIG. 21. The thickness of the PZT layer is 8 mil. All other layers of the piezoelectric component are the same thickness as the thicknesses described previously in the first example.

Following from the above description, it should be apparent to those of ordinary skill in the art that, while the designs and operations herein described constitutes several embodiments of the present invention, it is to be understood that the invention is not limited to these precise designs and operations, and that changes may be made therein without departing from the scope of the invention.

The invention claimed is:

1. A device for producing mechanical vibrations in response to an electrical signal, comprising:

a piezoelectric component having two opposing surfaces, said piezoelectric component further having at least two points where polarity is recognized; wherein the piezoelectric component has a T-shaped planform; and further comprising a clamp connected at the neck region of the T-shaped planform of the piezoelectric component for coupling the piezoelectric component to a base in a cantilever fashion.

2. The device according to claim 1, wherein the piezoelectric component comprises a unimorph piezoelectric structure having piezoelectric material bonded between two metallic support layers.

3. The device according to claim 1, wherein the piezoelectric component comprises a bimorph piezoelectric structure having piezoelectric material bonded to two different surfaces of a metallic support layer.

4. The device according to claim 1 wherein at least one acoustic member is attached to one of the surfaces of the piezoelectric component.

5. The device according to claim 1 further comprising means, positioned at one end of the piezoelectric component, for adjustably connecting the piezoelectric component to a base surface.

6. The device according to claim 1 wherein the mechanical vibrations are of sufficient force to produce audible sound over substantially the entire audible frequency range.

7. The device according to claim 1 wherein the mechanical vibrations are of sufficient force as to be readily felt by a holder of the device.

8. The deice according to claim 1 wherein a dampening material substantially covers at least one surface of the piezoelectric device, said dampening material has low elastic modulus substantially of that selected from the group of material comprising polyolefin, synthetic polyolefin, 3M Scotch™ 468 MP High Performance Adhesive and 3M Scotch™ 859 Removable Mounting Squares.

9. The device of claim 8 where one or more acoustic members are operatively connected to the surface of the piezoelectric device.

10. An acoustic member for amplifying sound, comprising:

a surrounding wall portion connected to two end portions, one of said end portions having an orifice to form a passageway therethrough, the other of said end portions is that of a mechanically excited vibrating surface to form an enclosed chamber to amplify sound generated by the mechanically excited vibrating surface, wherein said mechanically excited vibrating surface extends beyond the area of said surrounding wall portion in such a way as to allow multiple of said enclosed chamber to be placed thereon said mechanically excited vibrating surface.

11. The device of claim 10 where the mechanically excited vibrating surface is a piezoelectric device.

12. The device according to claim 11, wherein the point of attachment of at least one acoustic member is approximately at an anti-node of the piezoelectric component.

13. The device of claim 10 where the acoustic member is operatively connected to the surface of any transducer capable of producing mechanical vibrations.

14. A device for producing mechanical vibrations in response to an electrical signal, comprising:

a piezoelectric component having two opposing surfaces, said piezoelectric component further having at least two points here polarity is recognized; and wherein a dampening material substantially covers at least one surface of the piezoelectric device, said dampening material has low elastic modulus substantially of that selected from the group of material comprising polyolefin, synthetic polyolefin, 3M Scotch™ 468 MP High Performance Adhesive and 3M Scotch™ 859 Removable Mounting Squares.

* * * * *